US005092005A

United States Patent [19]

Byrn

[11] Patent Number: 5,092,005

[45] Date of Patent: Mar. 3, 1992

[54] PILLOW FOR USE BY NURSING

[76] Inventor: Helle Byrn, Birkevang 143, DK-3250 Gilleleje, Denmark

[21] Appl. No.: 603,715

[22] PCT Filed: May 18, 1989

[86] PCT No.: PCT/DK89/00128

§ 371 Date: Nov. 16, 1990

§ 102(e) Date: Nov. 16, 1990

[87] PCT Pub. No.: WO89/11264

PCT Pub. Date: Nov. 30, 1989

[30] Foreign Application Priority Data

May 18, 1988 [DK] Denmark ..... 2708/88

[51] Int. Cl.[5] ..... A47G 9/00

[52] U.S. Cl. ..... 5/636; 5/424

[58] Field of Search ..... 5/431, 434, 436, 424, 5/441, 449, 455; 128/134; 269/328; 108/43; 224/158; D6/596, 601

[56] References Cited

U.S. PATENT DOCUMENTS

| | | | |
|---|---|---|---|
| D. 259,458 | 6/1981 | Fuller et al. | D6/201 |
| D. 300,694 | 4/1989 | Krok | D6/604 |
| 2,269,884 | 3/1953 | McMonagle | 5/455 |
| 2,522,120 | 9/1950 | Kaskry et al. | 5/441 |
| 3,312,987 | 4/1967 | Emery | 5/441 |
| 4,060,863 | 12/1977 | Craig | 5/441 |

OTHER PUBLICATIONS

"Baby Care", A Sales Sheet Describing a Nursing Pillow Produced by Baby Care, San Mateo, Calif. 94402-5431.

*Primary Examiner*—Alexander Grosz
*Attorney, Agent, or Firm*—Kolisch, Hartwell, Dickinson, McCormack & Heuser

[57] ABSTRACT

An inflatable pillow (1) is intended for use during the feeding of a baby and includes an upper wall layer (2*a*) and a lower wall (2*b*), joined about the periphery thereof by an air-tight seal (3). A planar, baby-supporting depression (9) is defined in the pillow and is formed by the joining of the upper and lower layers along a reinforcement curve (8). A valve (5) is provided for inflating and deflating the pillow.

15 Claims, 2 Drawing Sheets

PILLOW FOR USE BY NURSING

The invention relates to a pillow for use by nursing.

Obviously, many women have problems placing themselves in a sufficiently relaxed position when nursing or breast feeding their babies, seeing that they have to carry a considerable part of the baby's weight in one arm. A sausage shaped pillow with an oval cross section and a length enabling the pillow to extend all around the mother's waist is known. The intention of this known pillow is that the mother should place it around her waist with its two ends in front of her, so that the baby can rest its head on the one end of the pillow, its legs on the other end and its seat or behind down between the two ends on the mother's thighs. The operations involved in using this pillow are complicated and require a bed, a couch or a big armchair to get enough space for the pillow, which, furthermore, the mother often has to keep in place or position with her elbows in order to prevent its ends to slide away under the baby.

The purpose of this invention is to provide a useful relief means rendering it possible for the mother to concentrate fully on nursing without having to use her strength to keep the baby or the pillow in position, and whereby the above drawbacks of the known pillow are eliminated.

Said purpose is obtained by a pillow according to the invention, which is characterized in that the pillow in its condition of use has a rigid C-shape which is determined by the shape of the pillow material, that the free ends of the C-shape are intended for being placed at the back of the mother when the opening of the C-shape is placed around the mother's waist, and that the interjacent part of the pillow, i.e. in the intermediate part of the C-shape, at least on its upper surface, has a hollow or depression preformed to the baby.

By such pillow the baby can be placed in said depression in a safe and stable position, and simultaneously the weight of the baby via the pillow is transferred to the lap of the mother. The pillow is safely maintained around the waist of the mother due to the fixed encircling form of the free ends of the C-shape around the mother's hips.

In a first embodiment of a pillow according to the invention, the pillow includes two substantially C-shaped layers of rubber or plastic material, which are joined together along their edges and provided with a valve for inflation of the pillow.

Thereby a low-cost pillow is obtained which in deflated condition is not very bulky and is easy to carry.

According to the invention the depression in the upper surface or the pillow may be provided along a linear, circular of elongated ovally extending reinforcement of the rubber or plastic material in the upper layer, preferably in form of a joining or connection of the upper and lower wall part of the pillow along the reinforcement curve.

As far as production technique is concerned, a simple method of providing the desired depression or hollow in the upper surface of the pillow, is to bond the upper and lower layer of material along what is referred to herein as a reinforcement curve 8 seeing that the reinforced areas during the inflation will expand less than the surrounding material.

In a preferred embodiment according to the invention the hollow may be elongated and having two ends, and the pillow may be thicker or higher outside the ends of the hollow than outside the sides of the hollow so that the pillow seen in a longitudinal section through the hollow is higher at both ends than at the middle of the hollow.

Thereby a comfortable support of the baby's head, body and legs during the nursing is obtained.

In another embodiment according to the invention the hollow may preferably be formed by a local reduction of the pillow thickness.

The extension of the hollow in the longitudinal direction thereof may preferably be approximately 1:3 of the largest dimension of the pillow in its inflated condition, and the extension of the hollow in the cross direction thereof is preferably approximately 1:4 to 1:3 of the largest cross section of the pillow at the middle of the C-shape in the inflated condition of the pillow.

At the inner middle zone, edge or contour of the C-shape in the deflated or uninflated condition the pillow preferably has a curved shape, i.e. a shape which differs from a linear joining edge. Thereby low tensile stresses in the wall material of the pillow in its inflated condition is obtained, especially in case the pillow has been manufactured from two substantially C-shaped plastic layers, and thereby a longer lifetime of the pillow is obtained.

The invention will now be described in more detail with reference to the drawings.

Figure 1:
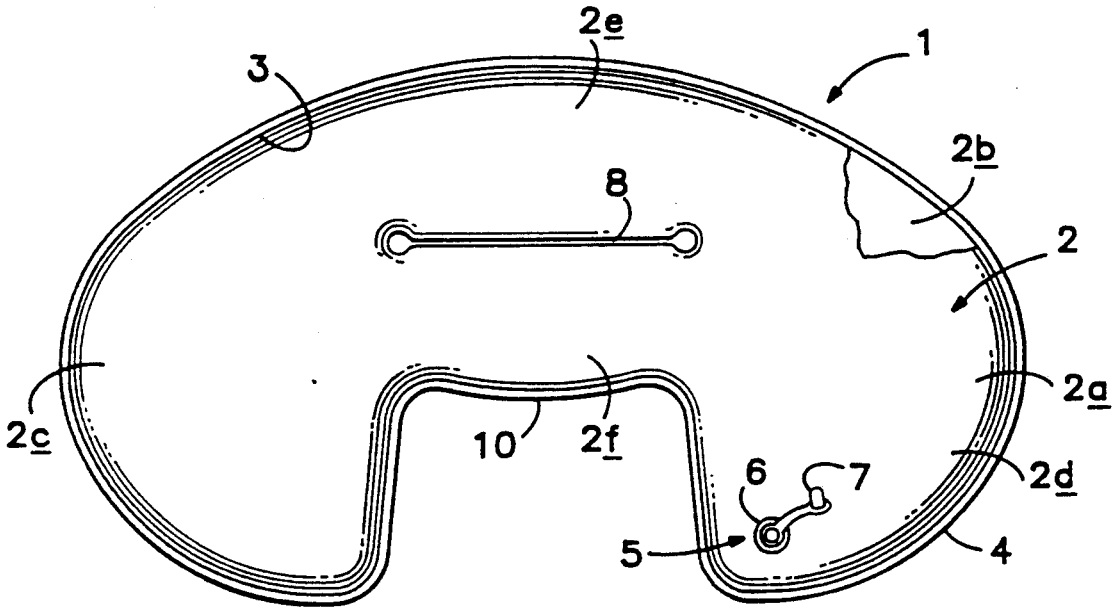
FIG. 1 shows a first embodiment of the invention in an uninflated condition.
Figure 2:
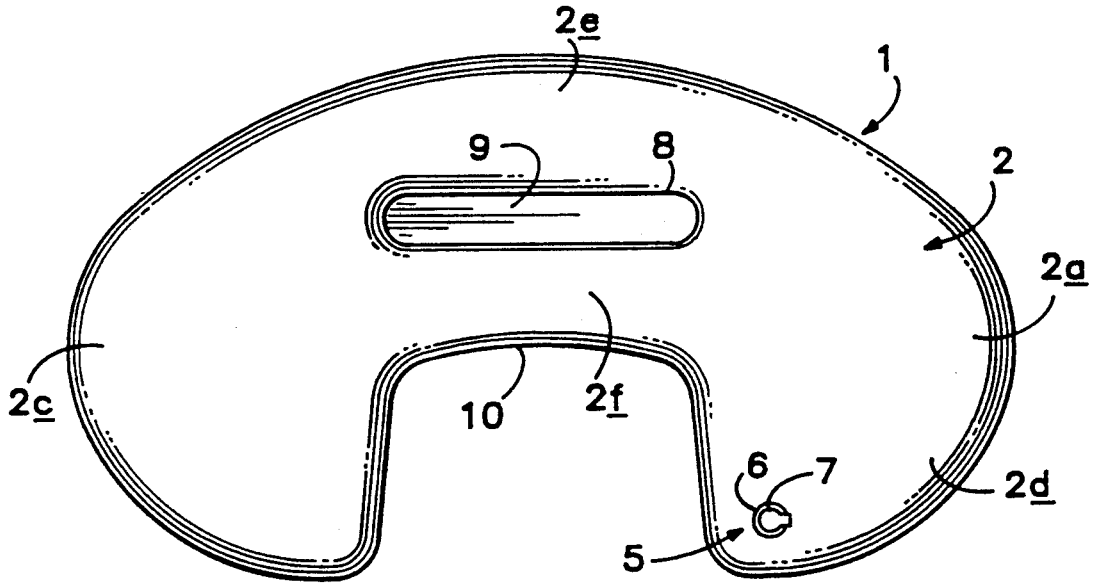
FIG. 2 shows a second embodiment of the pillow of the invention in its uninflated condition.

FIGS. 1 and 2 show flat or uninflated pillows 1 consisting of two substantially C-shaped layers 2, including an upper wall layer **2*a* and a lower wall layer 2*b*, of punched web material, e.g. rubber or plastic material, which layers along their contour or edges have been joined together by means of a known airproof welded seam 3 or in another appropriate way, e.g. by adhesion. The C-shaped layers form in FIG. 1 an annular flange 4 along their free outer edge next to the welding seams 3. The C-shape of the pillow includes a top portion 2*c*, a base portion 2*d*, and side portions 2*e* and 2*f***, forming the staff of the "C".

For inflation of the cavity between the two layers 2 joined in an airproof manner, a valve device 5 has been provided, the valve device includes of a welded-in pipe stub 6 and a matching or integrated closing plug 7.

In the intermediate area of the layer has been provided a linearly (FIG. 1) or elongated ovally (FIG. 2) extending reinforcement 8, e.g. performed as a welding seam between the layers 2.

Figure 3:
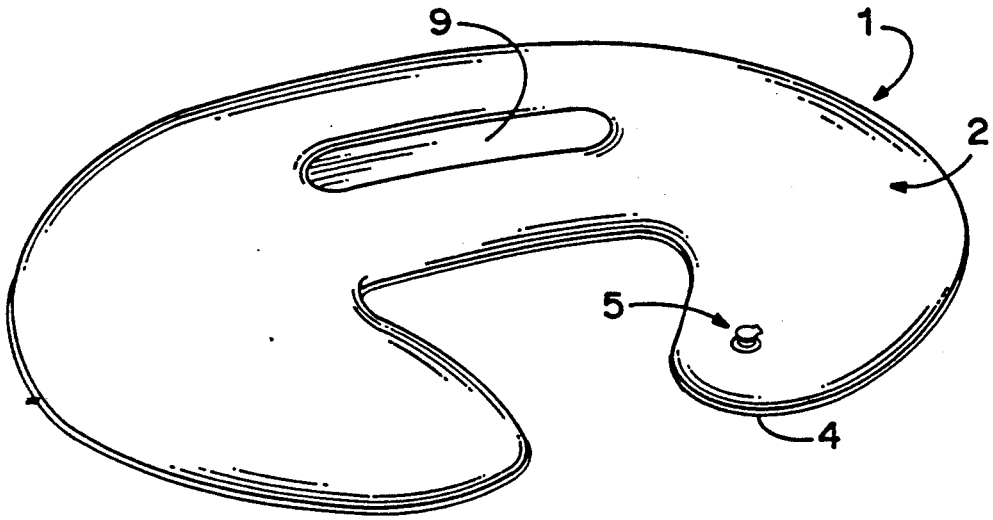
FIG. 3 is a perspective view of the inflated pillow of FIG. 2.
Figure 4:
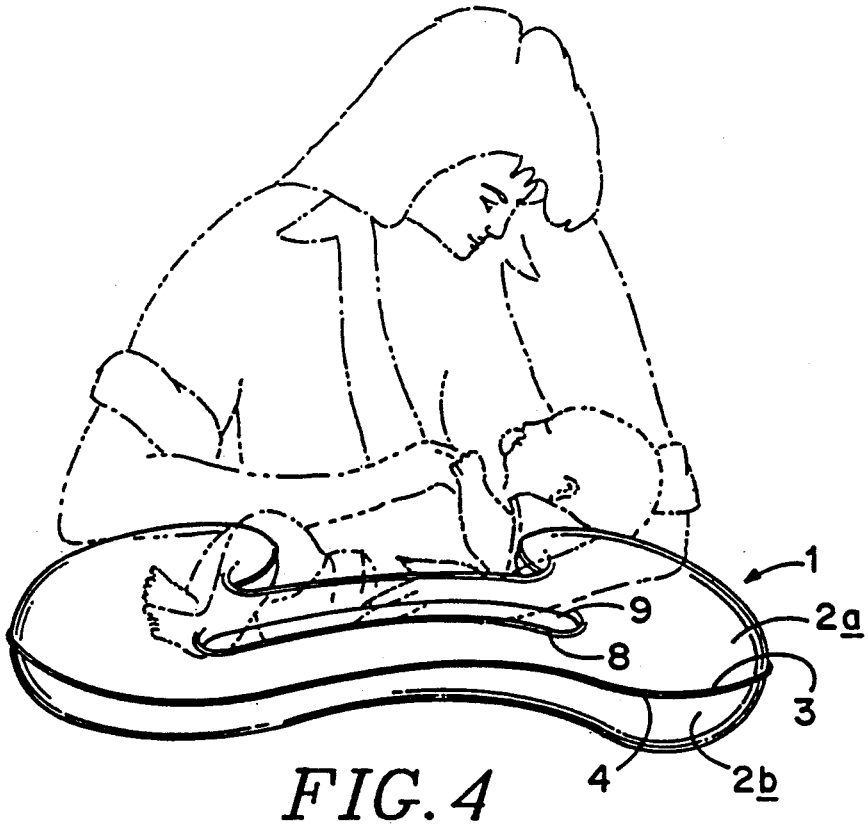
FIG. 4 depicts the pillow of the invention in use.

In FIG. 3 the pillow 1 is shown in its inflated condition. The linear or elongated ovally extending reinforcement 8 provides as shown a hollow region 9 in the upper surface of the pillow. Hollow region 9 defines a planar baby-supporting surface **9*a* which is formed by the joining of upper wall 2*a* and lower wall 2*b* along a reinforcement curve 8. Hollow region 9 has a size which will receive a baby therein and which will substantially prevent the baby from rolling out of the region, as depicted in FIG. 4**.

The free ends of the C-shape are flexible for arrangement against the hips of the mother so that the free ends oppose each other at the mother's back.

In FIGS. 1 and 2 the pillow has a curved shape at the inner intermediate zone or edge 10 of the C-shape in the uninflated condition of the pillow, seeing that the intermediate zone or contour 10 in FIG. 1 has a convex curved shape and in FIG. 2 has a concave curved shape. Said details will reduce the tensile stress in the intermediate zone 10 to lower values in the inflated condition of the pillow than if the intermediate zone 10 had been rectilinear.

The invention is not limited to the measures shown and described, and modifications of the pillow shaping and the choice of material will be possible within the spirit of the following claims.

I claim:

1. An inflatable pillow (1) for use during feeding of a baby comprising:

an upper wall layer (2*a*) and a lower wall layer (2*b*), joined about the periphery thereof by an air-tight seal (3), said layers being substantially C-shaped and being constructed and arranged such that the open ends of the C may be received about the feeder's waist; and a planar, baby-supporting depression (9) defined in the pillow formed by the joining of the upper and lower layers along a reinforcement curve (8).

2. The inflatable pillow of claim 1 wherein said baby-supporting depression (9) is substantially circular in shape.

3. The inflatable pillow of claim 1 wherein said baby-supporting depression (9) is substantially linear in shape and extends along a line between the top (2*c*) and base (2*d*) of the C.

4. The inflatable pillow of claim 1 wherein said baby-supporting depression (9) is substantially an elongated oval in shape and extends along a line between the top (2*c*) and base (2*d*) of the C.

5. The inflatable pillow of claims 2, 3 or 4 wherein the pillow (1) is thicker outside that portion of said depression adjacent the top (2*c*) and base (2*d*) of the C than it is along the sides (2*e*, 2*f*) of said depression intermediate the top (2*c*) and base (2*d*) of the C.

6. The inflatable pillow of claims 3 or 4 wherein said depression (9), along a long axis thereof is substantially 1:3 of the largest dimension of the pillow in its inflated condition and that said depression, in its cross direction has an extension of substantially 1:4–1:3 of the largest cross dimension of the pillow in the staff of the C with the pillow in its inflated condition.

7. The inflatable pillow of claim 1 wherein said layers have a curvedly extending shape at the inner middle zone (10) of the C-shape in the uninflated condition of the pillow.

8. An inflatable pillow (1) for use during feeding of a baby comprising:

an upper wall layer (2*a*) and a lower wall layer (2*b*), joined about the periphery thereof by an air-tight seal (3), wherein said layers (2) are substantially C-shaped, the open ends of the C adapted to be received about a feeder's waist; and a planar, baby-supporting depression (9) defined in the pillow formed by the joining of the upper and lower layers along a reinforcement curve (8).

9. The inflatable pillow of claim 8 wherein said baby-supporting depression (9) is substantially circular in shape.

10. The inflatable pillow of claim 8 wherein said baby-supporting depression (9) is substantially linear in shape and extends along a line between the top (2*c*) and base (2*d*) of the C.

11. The inflatable pillow of claim 8 wherein said baby-supporting depression (9) is substantially an elongated oval in shape and extends along a line between the top (2*c*) and base (2*d*) of the C.

12. The inflatable pillow of claims 9, 10 or 11 wherein the pillow (1) is thicker outside that portion of said depression adjacent the top (2*c*) and base (2*d*) of the C than it is along the sides (2*e*, 2*f*) of said depression intermediate the top (2*c*) and base (2*d*) of the C.

13. The inflatable pillow of claims 11 or 12 wherein said depression (9), along a long axis thereof is substantially 1:3 of the largest dimension of the pillow in its inflated condition and that said depression, in its cross direction has an extension of substantially 1:4–1:3 of the largest cross dimension of the pillow in the staff of the C with the pillow in its inflated condition.

14. The inflatable pillow of claim 8 wherein said layers have a curvedly extending shape at the inner middle zone (10) of the C-shape in the uninflated condition of the pillow.

15. The inflatable pillow of claim 8 which includes a valve (5) for inflation thereof.

* * * * *